United States Patent [19]

Gross et al.

[11] 4,297,662

[45] Oct. 27, 1981

[54] GAS-TIGHT-HIGH-FREQUENCY PERMEABLE WINDOW ARRANGEMENT IN A COAXIAL LINE, PARTICULARLY FOR TRAVELING WAVE TUBES

[75] Inventors: Franz Gross, Loerrach; Gerit Boehme, Germering; Wolf Wiehler, Neubiberg; Wilhelm Bibracher, Otterloh, all of Fed. Rep. of Germany

[73] Assignee: Siemens Aktiengesellschaft, Berlin & Munich, Fed. Rep. of Germany

[21] Appl. No.: 115,011

[22] Filed: Jan. 24, 1980

[30] Foreign Application Priority Data

Feb. 28, 1979 [DE] Fed. Rep. of Germany ..... 2907808

[51] Int. Cl.[3] ..... H01P 1/08; H01P 5/02

[52] U.S. Cl. ..... 333/252; 333/34; 333/260

[58] Field of Search ..... 333/252, 248, 245, 34, 333/33, 22 F, 260; 315/3.5, 39.53, 39

[56] References Cited

U.S. PATENT DOCUMENTS 3,058,073 10/1962 Eldredge ..... 333/94 X 3,065,377 11/1962 Eaken ..... 315/39.53 X 3,418,523 12/1968 Schmidt ..... 315/39.53 X

FOREIGN PATENT DOCUMENTS 1591596 5/1970 Fed. Rep. of Germany .

*Primary Examiner*—Marvin L. Nussbaum

*Attorney, Agent, or Firm*—Hill, Van Santen, Steadman, Chiara & Simpson

[57] ABSTRACT

A gas-tight, high-frequency permeable window arrangement is provided between the input and output sides of a coaxial line, particularly for traveling wave tubes. The dielectric losses, particularly given high-performance tubes, are held so low that too high a thermal load and, thus, a fracture or, respectively, loss of seal of the window arrangement is avoided. For this purpose, a ceramic hollow cylinder is provided between the coaxial line of the input side and the coaxial line of the output side, the ceramic hollow cylinders surrounding the inner conductor of the coaxial line of the input side in the area of its transition to the coaxial line of the output side as a continuation of the outer conductor of the coaxial line of the input side.

4 Claims, 3 Drawing Figures

GAS-TIGHT-HIGH-FREQUENCY PERMEABLE WINDOW ARRANGEMENT IN A COAXIAL LINE, PARTICULARLY FOR TRAVELING WAVE TUBES

BACKGROUND OF THE INVENTION

1. Field of the Invention

The present invention relates to a gas-tight, high-frequency permeable window arrangement between a coaxial line on the input side and a coaxial line on the output side, particularly for traveling wave tubes.

2. Description of the Prior Art

A gas-tight, high-frequency permeable window arrangement in a coaxial line, particularly for traveling wave tubes, is known from the German Letters Patent 1,591,596, in which a dielectric support is provided, through which the inner conductor of the coaxial line is extended with an exterior diameter which is smaller than the normal inner conductor diameter in the coaxial line, but which is greater than the reduced inner conductor diameter necessary in the area of the support for an adaptation of the surge impedance of the passage to the surge impedance of the line. In this window arrangement, the inner conductor is conically enlarged in the direction toward the support on both sides of the support. However, in this window arrangement the dielectric support which, for example, can consist of ceramic material, is designed in the form of a disc so that relatively high dielectric losses can occur, particularly given high-performance tubes, and the thermal load of the dielectric support which occurs can lead to damage thereof.

SUMMARY OF THE INVENTION

The primary object of the present invention, therefore, is to provide a gas-tight, high-frequency permeable window arrangement which is particularly suited for traveling wave tubes of high output.

In order to achieve the above object, according to the present invention, in a gas-tight, high-frequency permeable window arrangement of the type generally mentioned above, a ceramic hollow cylinder is arranged between the coaxial line on the input side and the coaxial line on the output side, the hollow cylinder surrounding the inner conductor of the coaxial line of the input side in the area of the transition to the coaxial line of the output side as a continuation of the outer conductor of the coaxial line of the input side.

Preferably, the end face of the ceramic hollow cylinder at the output side is provided with a membrane consisting of metal, the membrane being connected gas-tight to the inner conductor of the coaxial line of the input side and to the inner conductor of the coaxial line of the output side. It is particularly advantageous to provide the membrane with a ceramic counter ring on the side facing away from the front face of the ceramic hollow cylinder. In accordance with a advantageous development of the invention, an annular, metallic adaptation element which coaxially surrounds the ceramic hollow cylinder is provided on the inside of an outer sheath flanged onto the outer conductor of the coaxial line of the input side.

A window constructed in accordance with the present invention has the advantage that, even given high-performance traveling wave tubes, the dielectric losses in the high-frequency permeable window are maintained low, so low that too high a thermal load and, thus, a fracture or, respectively, loss of seal of the window is avoided.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
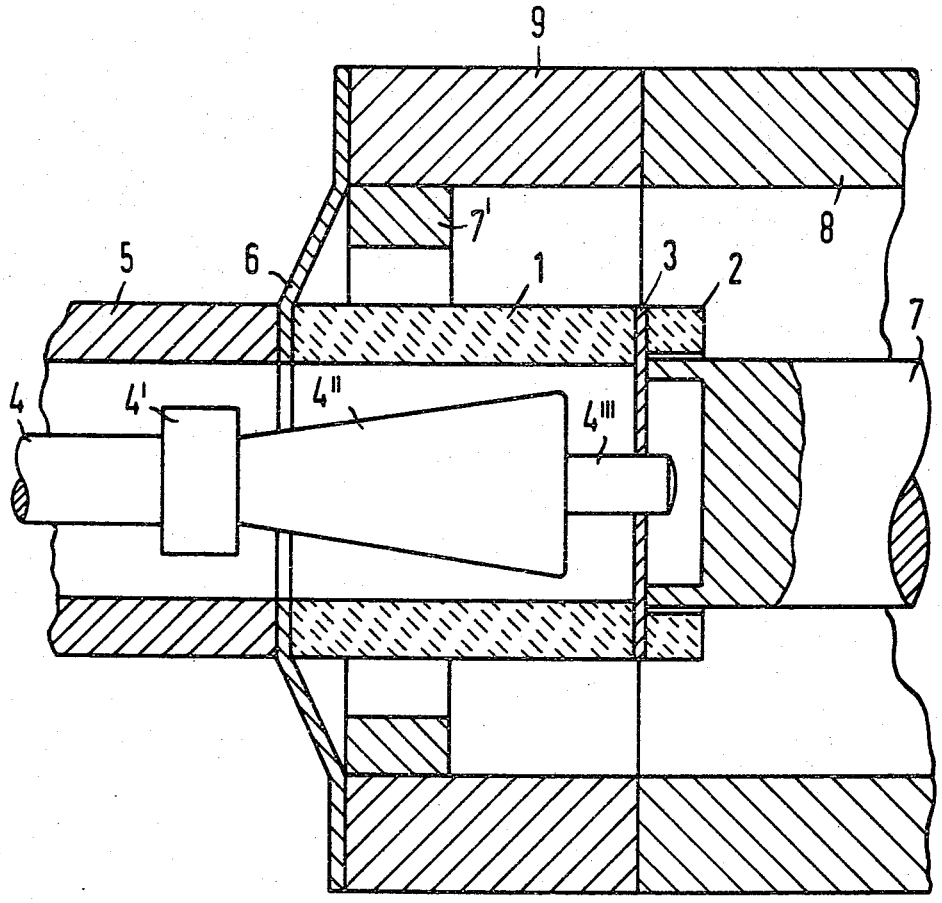
FIG. 1 is a sectional view of a window arrangement constructed in accordance with the present invention.

In the window arrangement illustrated in FIG. 1, the output coupled from a delay line of the amplifier (not shown) is supplied to a coaxial line 4, 5 at the input side of the window arrangement. The window arrangement comprises a ceramic hollow cylinder 1 having one end face which is soldered to a flange 6, and another end face which is soldered to a membrane 3 with a ceramic counter ring 2. The inner conductor 7 of the coaxial line 7, 8 at the output side is also connected to the membrane 3. A cylindrical element 4', a conical element 4'' and a thin peg 4''' are connected in series on the inner conductor 4, these elements, together with the adaptation element 7', adapting the window arrangement over a broad frequency band without reflection to the coaxial connection lines ($r<10\%$ over more than 30% bandwidth). At the peg 4''', the inner conductor 4 is advantageously very thin so that the membrane 3 does not become too stiff and cannot give way when the inner conductor 4 exerts a force on the membrane 3 due to thermal expansion.

The window arrangement can be simply manufactured and is both mechanically and thermally stable. This is preferably achieved in that the ceramic hollow cylinder 1 is soldered in copper on both sides. For improving the stability, a material with a coefficient of thermal expansion similar to $Al_2O_3$, for example Vacon, is soldered to the coaxial line 4, 5 as an outer conductor at the side of a flange 6. For the same reason, a ceramic counter ring 2 is soldered on at the side of the membrane 3. Given very high thermal loads, the cooling of an outer sleeve 9, for example, a water cooling, which can be realized in a simple manner, is recommended.

Figure 2:
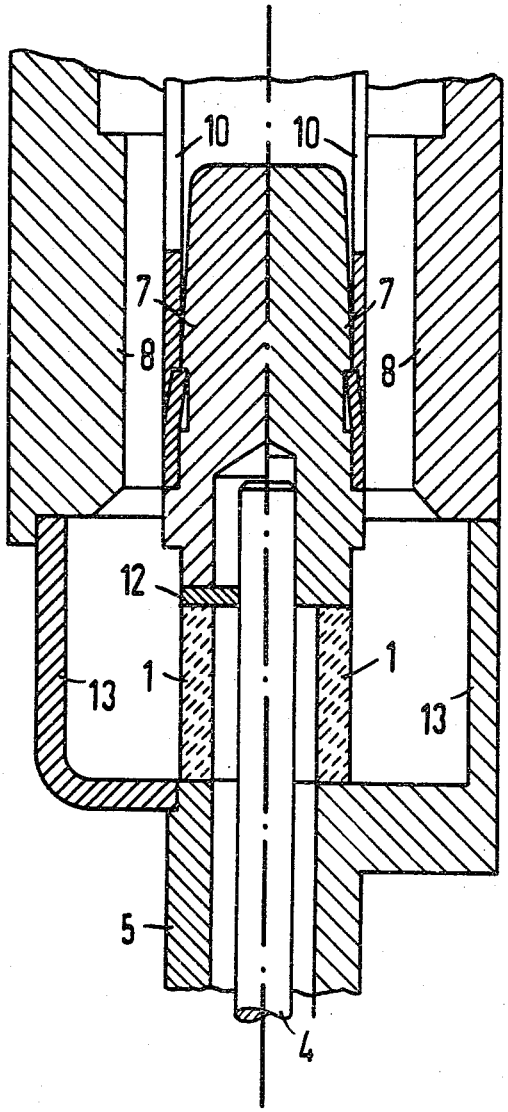
FIG. 2 illustrates, in a sectional view, illustrates further exemplary embodiments of the invention, in which the left-hand side illustrates one embodiment, while the right-hand side illustrates another embodiment.
Figure 3:
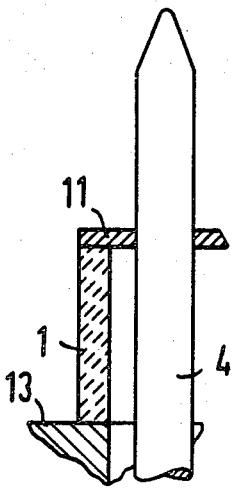
FIG. 3 illustrates, in a sectional fragmentary view, a fourth exemplary embodiment of a window arrangement constructed in accordance with the invention.

The fundamental arrangement of the exemplary embodiments illustrated in FIGS. 2 and 3 is the same as that of the exemplary embodiment of FIG. 1. Two exemplary embodiments are illustrated in FIG. 2. In the embodiment on the left-hand side, the ceramic hollow cylinder 1 is soldered gas-tight at one side to a Vacon mount 13, 5, 8 adapted in terms of expansion and is soldered at the other side by way of a ductile copper disc 12 to the connection element 7, likewise consisting of Vacon. The inner conductor 4 is soldered to the soft copper disc 12. In the exemplary embodiment illustrated on the right-hand side of FIG. 2, the ceramic hollow cylinder 1 is soldered at both ends to Vacon turned parts 13, 8, 7. The inner conductor 4 is directly soldered to the connection element 7 which also consists of Vacon.

In the exemplary embodiment illustrated in FIG. 3, the ceramic hollow cylinder 1 is soldered at one side to a solid Vacon mount 13 and at the other side to a thin Vacon disc 11.

In the exemplary embodiment of FIG. 2, a contact spring 10 is attached after the tubes are heated.

Gold or silver solders can be employed as solders; in the exemplary embodiments according to FIGS. 2 and 3, pure copper can also be employed.

Since the electric field lines in the exemplary embodiments illustrated on the drawings only partially proceed in the dielectric and predominantly in air, the dielectric load of the ceramic hollow cylinder is low, so that broad band window arrangements can also be constructed with $Al_2O_3$ ($\epsilon=9$).

The invention is not limited to the exemplary embodiments illustrated on the drawings. For example, the inner conductor 4 illustrated in FIG. 1 can also have cylindrical transformation elements instead of the conical structure.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A gas-tight, high-frequency permeable window arrangement between a coaxial line on an input side and a coaxial line on an output side, each of the coaxial lines having respective inner and outer conductors, particularly for traveling wave tubes, comprising:

a ceramic hollow cylinder arranged between the input side and the output side, said cylinder surrounding the inner conductor of the input side in the area of its transition to the coaxial line of the output side and connected as a continuation of the outer conductor of the coaxial line of the input side; and a membrane connected gas-tight to the inner conductor of the coaxial line at the input side and to the inner conductor of the coaxial line of the output side.

2. The arrangement of claim 1, wherein:

said membrane is a metal membrane.

3. The arrangement of claim 2, comprising:

a ceramic ring connected to the side of said membrane which faces away from the ceramic hollow cylinder.

4. The arrangement of claim 3, comprising:

an outer sheath;

a flange connecting said outer sheath and the outer conductor at the input side; and said ceramic hollow cylinder connected to said flange at the input side.

* * * * *